US005902052A

United States Patent [19]

Hayashi

[11] Patent Number: 5,902,052

[45] Date of Patent: May 11, 1999

[54] COLOR IMAGE-FORMING MACHINE AND METHOD OF FORMING A CORRECTION TABLE THEREFOR

[75] Inventor: Shuji Hayashi, Osaka, Japan

[73] Assignee: Mita Industrial Co., Ltd., Osaka, Japan

[21] Appl. No.: 08/831,431

[22] Filed: Apr. 1, 1997

[30] Foreign Application Priority Data

Apr. 8, 1996 [JP] Japan ..... 8-84895

[51] Int. Cl.[6] ..... B41J 2/36

[52] U.S. Cl. ..... 400/120.02; 347/43

[58] Field of Search ..... 400/120.02; 347/15, 347/19, 43; 395/109; 358/504, 518, 521

[56] References Cited

U.S. PATENT DOCUMENTS 4,651,287 3/1987 Tsao ..... 347/15

4,829,323 5/1989 Suzuki ..... 347/15

4,962,421 10/1990 Murai ..... 358/504

5,587,728 12/1996 Edgar ..... 347/43

*Primary Examiner*—Edgar S. Burr

*Assistant Examiner*—Steven S. Kelley

*Attorney, Agent, or Firm*—Beveridge, DeGrandi, Weilacher & Young, LLP

[57] ABSTRACT

A color image-forming machine comprises a color image signal-forming means for outputting digital signals Cd, Md and Yd expressing, on tone levels, three primary colors C, M and Y for each of a number of pixels, and a correction means for correcting the digital signals Cd, Md and Yd by using a correction table. The correction table is formed by forming masking operation correction tables using many masking operation expressions, and then, detecting singular portions in the masking operation correction tables, and modifying the detected singular portions.

8 Claims, 4 Drawing Sheets

COLOR IMAGE-FORMING MACHINE AND METHOD OF FORMING A CORRECTION TABLE THEREFOR

FIELD OF THE INVENTION

The present invention relates to a color image-forming machine equipped with a correction means which corrects digital signals Cd, Md and Yd expressing, on tone levels, three primary colors of C (which means "Cyan" in this specification), M (which means "Magenta" in this specification) and Y (which means "Yellow" in this specification) according to a correction table; and to a method of forming the above correction table.

DESCRIPTION OF THE PRIOR ART

As is well known, a color copying machine which is a typical example of the color image-forming machine is equipped with a color image signal-forming means which includes a color image reading means and a conversion means. The color image reading means decomposes light reflected by each of a number of pixels on a document having color image into three primary colors R (which means "red" in this specification), G (which means "green" in this specification) and B (which means "blue" in this specification) in order to form analog signals Ra, Ga and Ba. The conversion means converts such analog signals Ra, Ga and Ba into digital signals Cd, Md and Yd that express, on tone levels, the three primary colors C, M and Y. The three primary colors C, M and Y have a complementary color relationship to the R, G and B, respectively. When expressed in 8-bit data on tone levels, i.e., on 0 to 255 tone levels, then C=255−R, M=255−G, and Y=255−B. When the color image-forming machine is a color printer, the color image signal-forming means forms the above-mentioned digital signals Cd, Md and Yd based on the signals which are received from a computer or the like in relation to a number of pixels. The color image-forming machine is further equipped with a color image-forming means which applies a C-color material, an M-color material and a Y-color material based on the digital signals Cd, Md and Yd, respectively and further applies a BK-color material (BK means "black" in this specification) in order to save the C-color material, M-color material and Y-color material and/or to improve reproduceability of BK, and thus forms a color image. As the color material, there is usually used a toner or an ink.

As is known among people skilled in the art, the C-color material, M-color material and Y-color material used for forming a color-copied image do not have ideal spectral characteristics but contain so-called turbid components. Besides, the analog signals Ra, Ga and Ba formed by the color image reading means are not based on ideal spectral characteristics and contain distortion ascribed to characteristics of the color image reading means. In view of such circumstances, Japanese Laid-Open Patent Publication (Kokai) No. 7855/1989 discloses a method according to which digital signals Cd, Md and Yd formed by a color image signal-forming means are corrected based upon a masking operation expression (A) mentioned below, and a color image is formed based upon the corrected digital signals Cd", Md" and Yd". In the following masking operation expression, a coefficient $a_{ij}$ (where i=1, 2, 3, j=1, 2, 3) can be set either experimentally or theoretically.

$$\begin{vmatrix} Cd'' \\ Md'' \\ Yd'' \end{vmatrix} = \begin{vmatrix} a_{11} & a_{12} & a_{13} \\ a_{21} & a_{22} & a_{23} \\ a_{31} & a_{32} & a_{33} \end{vmatrix} \begin{vmatrix} Cd \\ Md \\ Yd \end{vmatrix} \quad \text{(A)}$$

Furthermore, Japanese Laid-Open Patent Publication (Kokai) No. 113126/1994 discloses a method of changing the coefficient $a_{ij}$ in the masking operation expression depending upon the tone levels of each of the digital signals Cd, Md and Yd in order to improve color reproduceability. More specifically, the publication discloses that the digital signals Cd, Md and Yd are corrected by using different masking operation expressions, i.e., by using masking operation expressions having different coefficients $a_{ij}$ depending upon to which divided range formed by dividing the whole gradation range into plural ranges (e.g. three ranges) the digital signals Cd, Md and Yd belong.

The present inventor has conducted diligent study and experiment repetitively concerning the method of correcting colors, disclosed in Japanese Laid-Open Patent Publication (Kokai) No. 113126/1994, but could not accomplish color reproduction which is enough satisfactory in all color regions despite the whole tone range was divided into a relatively large number of ranges. For example, when the coefficient $a_{ij}$ is so set that the color in the C-region, can be favorably reproduced, the color reproduceability becomes insufficient in other color regions.

In view of such circumstances, the present inventor has previously proposed in U.S. patent application Ser. No. 08/715,000 filed on Sep. 17, 1996, a method according to which it is determined to which one of a predetermined plural number of color regions each of a number of pixels belongs, and a different masking operation expression is selected for each of the plurality of color regions thereby to correct the digital signals Cd, Md and Yd.

When a system is employed for correcting the digital signals Cd, Md and Yd by using many masking operation expressions, it is desired to form a number of correction tables by executing, in advance, operations based upon many masking operation expressions from the standpoint of increasing the processing speed, and make a reference to correction tables for correcting the digital signals Cd, Md and Yd to practically form an image.

When the coefficients $a_{ij}$ in the masking operation expressions for correcting the digital signals Cd, Md and Yd are suitably changed according to a plurality of color regions as described above and according to the tone levels of the digital signals Cd, Md and Yd, a singular relation tends to occur in the tone level correlation between the digital signals Cd, Md, Yd before being corrected and the digital signals Cd", Md", Yd" after being corrected, particularly, in a boundary region where the coefficients $a_{ij}$ in the masking expressions are changed. Examples of such a singular relation may include the one in which an increment and an inversion are reversed, i.e., in which the digital signals Cd", Md" and Yd" after being corrected decrease despite an increase of the digital signals Cd, Md and Yd before being corrected, and the one in which a sharp increase (or decrease) occurs for an increase (or decrease), i.e., in which the digital signals Cd", Md" and Yd" after being corrected increase (or decrease) greatly despite a slight increase (or decrease) of the digital signals Cd, Md and Yd before being corrected. When such a singular relation is retained in the correction tables without being corrected, the color density changes sharply in the portions of the formed color image where the density should change mildly, resulting in the formation of so-called pseudo-contours.

SUMMARY OF THE INVENTION

The object of the present invention is to provide a color image-forming machine equipped with masking operation correction tables defining corrected digital signals Cd", Md" and Yd" obtained by correcting digital signals Cd, Md and Yd (when used in the claims, the words "digital signals Cd, Md and Yd" used in this specification include not only the digital signals Cd, Md and Yd output by the color image signal-forming means but also the digital signals Cd', Md' and Yd' obtained by subjecting the digital signals Cd, Md and Yd to the a suitable processing such as underground-removal processing or the like) by using a plurality of masking operation expressions, that are different corresponding to each of a predetermined plural number of regions, wherein a singular relation between the digital signals Cd, Md, Yd before being corrected and the digital signals Cd", Md", Yd" after corrected in the masking operation correction tables is suitably modified in order to avoid the formation of pseudo-contours that are not desired for the color image formed.

Another object of the present invention is to provide a method of forming a correction table which makes it possible to fully avoid the formation of pseudo-contours that are not desired for the color image formed by the color image-forming machine by suitably correcting a singular relation between the digital signals Cd, Md, Yd of before being corrected and the digital signals Cd", Md", Yd" after corrected in the masking operation correction tables defining the corrected digital signals Cd", Md", Yd" obtained by correcting the digital signals Cd, Md, Yd based on a plurality of masking operation expressions that are different for each of a predetermined plural number of regions.

In order to accomplish the above-mentioned objects according to the present invention, masking operation correction tables are formed to define the corrected digital signals Cd', Md' and Yd' by correcting the digital signals Cd, Md and Yd based on a plurality of masking operation expressions which are different for each of a predetermined plural number of regions, singular portions are then detected on the corrected digital signals Cd', Md' and Yd' defined by the above-mentioned masking operation correction tables, and the corrected digital signals Cd', Md' and Yd' are modified at the detected singular portions.

That is, according to one aspect of the present invention, there is provided a color image-forming machine comprising a color image signal-forming means for outputting digital signals Cd, Md and Yd expressing, on tone levels, three primary colors C, M and Y for each of a number of pixels, and a correction means for correcting the digital signals Cd, Md and Yd; wherein said correction means includes a correction table and corrects said digital signals Cd, Md and Yd according to said correction table; and said correction table is formed by forming masking operation correction tables which define corrected digital signals Cd', Md'and Yd' obtained by correcting the digital signals Cd, Md and Yd based on a plurality of different masking operation expressions corresponding to a predetermined plural number of regions, and then, detecting singular portions on the corrected digital signals Cd', Md' and Yd' defined by said masking operation correction tables, and modifying the corrected digital signals Cd', Md' and Yd' at said singular portions.

According to another aspect of the present invention, there is provided a method of forming a correction table in a color image-forming machine comprising a color image signal-forming means for outputting digital signals Cd, Md and Yd expressing, on tone levels, three primary colors C, M and Y for each of a number of pixels, and a correction means for correcting the digital signals Cd, Md and Yd based on said correction table; wherein masking operation correction tables are formed to define the corrected digital signals Cd', Md' and Yd' obtained by correcting the digital signals Cd, Md and Yd based on a plurality of different masking operation expressions corresponding to a predetermined number of regions, and then, singular portions are detected in the corrected digital signals Cd', Md' and Yd' defined by said masking operation correction tables, and the corrected digital signals Cd', Md' and Yd' are modified at said singular portions.

It is desired that the singular portions are detected by detecting the corrected digital signals Cd', Md' and Yd' that have decreased or increased in excess of a predetermined range when the digital signals Cd, Md and Yd have increased by predetermined tone levels in each of the three primary colors C, M and Y. In a preferred embodiment, the plurality of masking operation expressions include masking operation expressions selected for a plurality of predetermined color regions which are determined based on a relative ratio of the digital signals Cd, Md and Yd. It is desired that the plurality of color regions include a GR-(which means "gray" in this specification) region, a C-region, a B-region, a G-region, a Y-region, an M-region, an R-region and an S-(which means "skin color" in this specification) region. Desirably, the plurality of masking operation expressions include masking operation expressions selected for the tone level regions that are obtained by dividing the whole tone level ranges of the digital signals Cd, Md and Yd into a plurality of ranges in each of said plurality of color regions.

DETAILED DESCRIPTION OF THE PREFERRED EMBODIMENTS

A preferred embodiment of a color image-forming machine of the present invention will now be described in detail with reference to the accompanying drawings.

Figure 1:
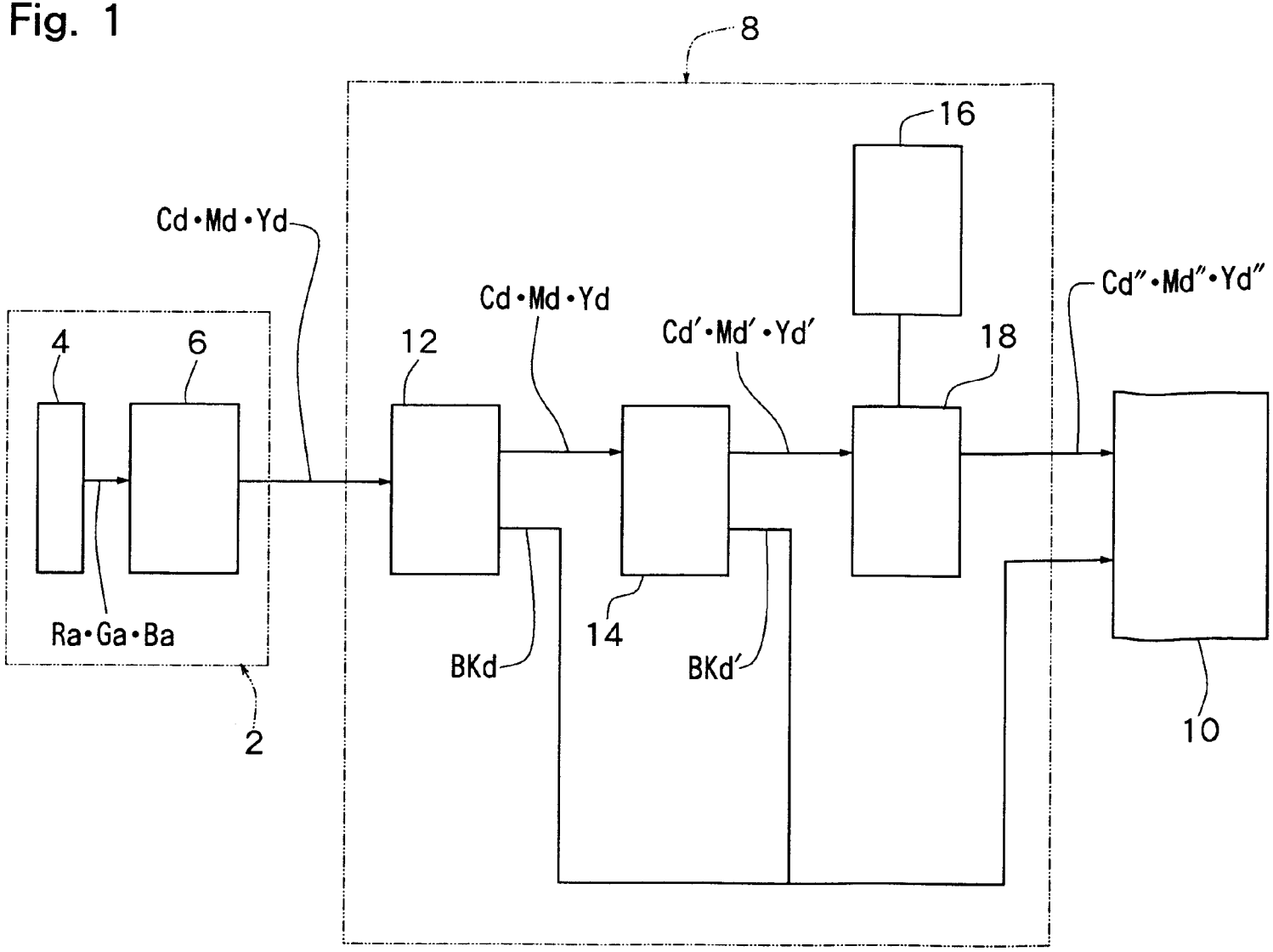
FIG. 1 is a block diagram schematically illustrating a mode of image signal processing in a color copying machine which is a color image-forming machine constituted according to an embodiment of the present invention.

FIG. 1 is a block diagram schematically illustrating a manner of processing image signals in a color copying machine which is an embodiment of a color image-forming machine constituted according to the present invention. The diagramed color copying machine includes a color image signal-forming means 2 which is constituted by a color image reading means 4 and a conversion means 6. It is preferable that the color image reading means 4 has a number of CCDs (charge-coupled devices) arranged in the main scanning direction, the number of CCDs being each provided with any one of a B-filter, a G-filter and an R-filter. The color image reading means 4 is scan-moved relatively in a sub-scanning direction with respect to a color document which is irradiated with light, and decomposes the reflected light for each of a number of pixels on the color document into three primary colors R, G and B in the additive mixture process to form analog signals Ra, Ga and Ba. The conversion means 6 converts the analog signals Ra, Ga and Ba into digital signals Cd, Md and Yd to express, on tone levels, the three primary colors C, M and Y in the subtractive mixture process. The digital signals Cd, Md and Yd usually express the C, M and Y in 8-bit data on tone levels, i.e., on 0 to 255 tone levels. As is well known, the C, M and Y have complementary color relationships to the R, G and B, respectively. When expressed on 0 to 255 tone levels, therefore, there are built up relationships of C=255−R, M=255−G and Y=255−B. Based on such relationships, the conversion means 6 converts the above-mentioned analog signals Ra, Ga and Ba into the above-mentioned digital signals Cd, Md and Yd. During the conversion, furthermore, a shading correction (for correcting fluctuation in the lamps for illuminating a color document) and a logarithm correction (for correcting nonlinearity in the CCD output) that are well known among people skilled in the art are executed.

With further reference to FIG. 1, the digital signals Cd, Md and Yd output from the conversion means 6 are subjected to a signal processing which is generally designated at 8 and are fed to a color image-forming means 10. The color image-forming means 10 may be the one which forms electrostatic latent image by selectively projecting laser beams onto a photosensitive material for each of C, M, Y and BK and develops the electrostatic latent image with C-toner, M-toner, Y-toner and BK-toner. In the signal processing 8, first, a black-forming processing 12 is executed. In the black-forming processing 12, black pixels are selected out of many pixels of the color image, and a digital signal BKd corresponding thereto is formed. The thus formed digital signal BKd is fed to a color image-forming means 10. In the black pixels, the digital signals Cd, Md and Yd are substantially the same and have tone levels larger than a predetermined value, and black pixels are selected based on this fact. Then, the digital signals Cd, Md and Yd related to pixels other than the black pixels are subjected to a background removal processing 14. In the background removal processing 14, minimum values min(Cd, Md, Yd) are picked up out of Cd, Md and Yd in the pixels, and values αmin(Cd, Md, Yd) obtained by multiplying the minimum values by a coefficient a are output as a BK component BKd'. The coefficient a may be, for example, about 0.5. The thus formed digital signal BKd' [=αmin(Cd, Md, Yd)] is fed to the color image-forming means 10. As is well known among people skilled in the art, removal of the background is executed in an attempt to substitute the use of the BK toner which is relatively cheap partly for the use of the C-toner, M-toner and Y-toner which are relatively expensive in the developing.

Next, the digital signals Cd' (=Cd−BKd'), Md' (=Md−BKd') and Yd' (=Yd−BKd') from which the backgrounds are removed are subjected to the correction processing 18 according to a correction table 16 (the correction table 16 will be described later in detail), and are then fed to a color image-forming means 10. As desired, instead of correcting the digital signals Cd', Md' and Yd' from which the undergrounds are removed according to the correction table 16, the digital signals Cd, Md and Yd may be directly subjected to the correction processing according to the correction table without removing backgrounds therefrom.

Figure 2:
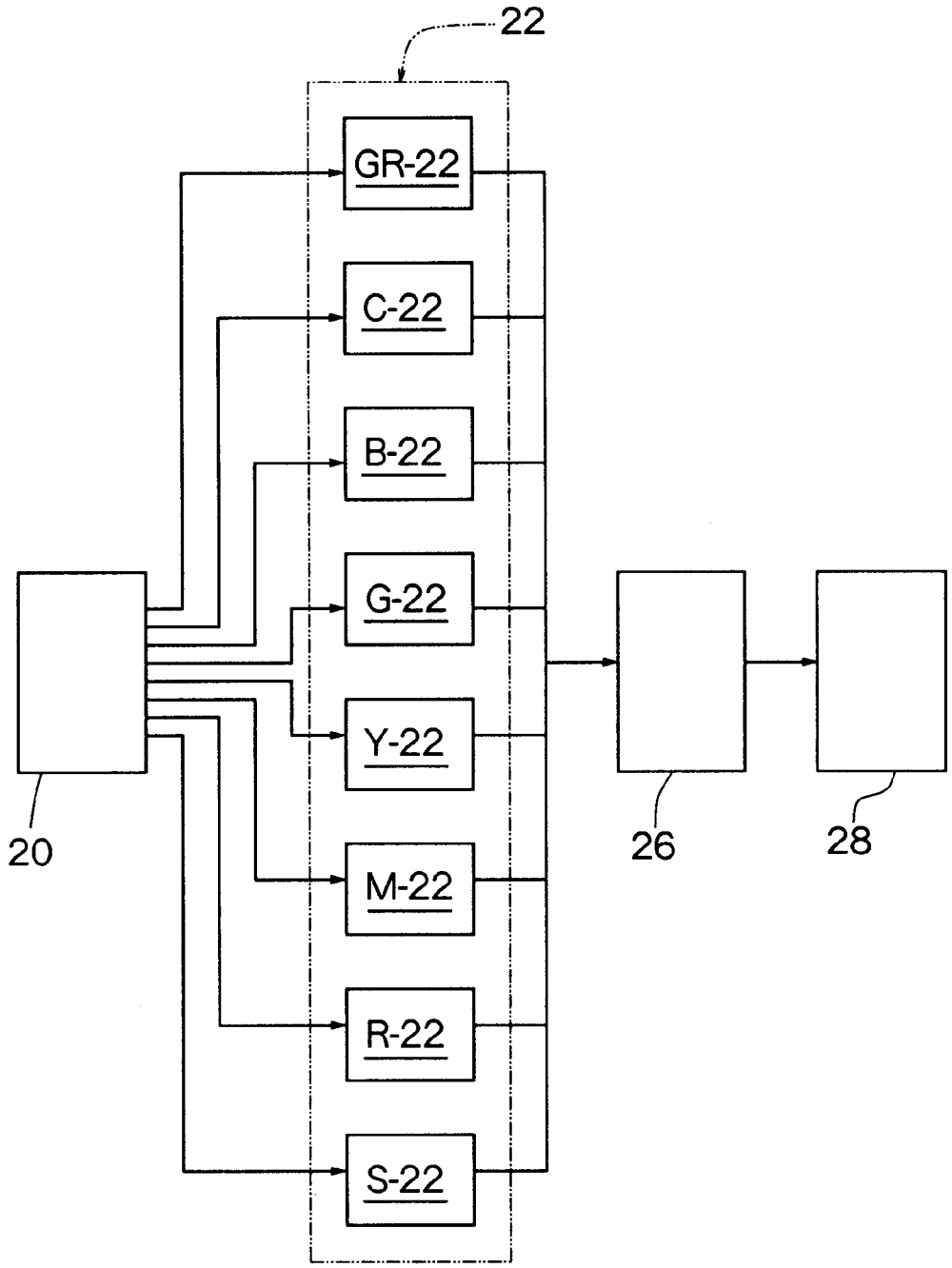
FIG. 2 is a block diagram illustrating a mode of forming a correction table used for the correction processing in the color image-forming machine of FIG. 1.

Described below with reference to FIG. 2 is a preferred embodiment for forming the correction table 16 used for the correction processing 18. A first step for forming the correction table 16 is a color region discrimination processing 20 in which it is discriminated to which one of a plurality of color regions, preferably, to which one of eight color regions, i.e., GR-region, C-region, B-region, G-region, Y-region, M-region, R-region and S-region, a pixel defined by the digital signals Cd', Md' and Yd' belongs, based upon a relative ratio of Cd', Md' and Yd'. In further detail, in the preferred embodiment, the color region discrimination processing 20 is executed in accordance with the following procedure.

(1) In a first step, it is discriminated whether the pixels belong to the GR-region or not. The discrimination is based on whether Cd', Md' and Yd' exist relatively uniformly or not. It is discriminated that the pixels belong to the GR-region when both of
$0.6<Md'/Yd'<1.3$
$0.6<Md'/Cd'<1.3$ are satisfied, when both of
$0.6<Cd'/Yd'<1.3$
$0.6<Cd'/Md'<1.3$ are satisfied, and when both of
$0.6<Yd'/Md'<1.3$
$0.6<Yd'/Cd'<1.3$ are satisfied.

(2) In a second step, it is discriminated whether those pixels that were discriminated not to belong to the GR-region in the first step, belong to the C-region or not. This discrimination is based on whether Md' and Yd' are both lower than Cd' or not. It is discriminated that the pixels belong to the C-region when both of
$Md'/Cd'<0.6$
$Yd'/Cd'<0.6$ are satisfied.

(3) In a third step, it is discriminated whether those pixels that were discriminated not to belong to the GR-region in the first step and were discriminated not to belong to the C-region in the second step, belong to the B-region or not. This discrimination is based on whether Yd' is lower than Cd' and Md' or not. It is discriminated that the pixels belong to the B-region when both of
$Yd'/Md'<0.5$
$Yd'/Cd'<0.5$ are satisfied.

(4) In a fourth step, it is discriminated whether those pixels that were discriminated not to belong to the GR-region in the first step, discriminated not to belong to the C-region in the second step and discriminated not to belong to the B-region in the third step, belong to the G-region or not. This discrimination is based on whether Md' is lower than Cd' and Yd' or not. It is discriminated that the pixels belong to the G-region when both of
$Md'/Cd'<0.6$
$Md'/Yd'<0.6$ are satisfied.

(5) In a fifth step, it is discriminated whether those pixels that were discriminated not to belong to the GR-region in the first step, discriminated not to belong to the C-region in the second step, discriminated not to belong to the Bregion in the third step and were discriminated not- to belong to the G-region in the fourth step, belong to the Y-region or not. This discrimination is based on whether Md' is lower than Yd' and whether Cd' is smaller than a predetermined value or not. It is discriminated that the pixels belong to the Y-region when both of Md'/Yd'<0.3

Cd'/255<0.1 are satisfied.

(6) In a sixth step, it is discriminated whether those pixels that were discriminated not to belong to the GR-region in the first step, discriminated not to belong to the C-region in the second step, discriminated not to belong to the B-region in the third step, discriminated not to belong to the G-region in the fourth step and discriminated not to belong to the Y-region in the fifth step, belong to the M-region or not. This discrimination is based on whether Cd' and Yd' are both lower than Md'. It is discriminated that the pixels belong to the M-region when both of Cd'/Md'<0.3

Yd'/Md'<0.55 are satisfied.

(7) In a seventh step, it is discriminated whether those pixels that were discriminated not to belong to the GR-region in the first step, discriminated not to belong to the C-region in the second step, discriminated not to belong to the B-region in the third step, discriminated not to belong to the G-region in the fourth step, discriminated not to belong to the Y-region in the fifth step and discriminated not to belong to the M-region in the sixth step, belong to the R-region or not. This discrimination is based on whether Cd' is lower than Md' and Yd. It is discriminated that the pixels belong to the R-region when both of Cd'/Md'<0.3

Cd'/Yd'<0.3 are satisfied.

(8) In an eighth step, it is discriminated whether those pixels that were discriminated not to belong to the GR-region in the first step, discriminated not to belong to the C-region in the second step, discriminated not to belong to the B-region in the third step, discriminated not to belong to the G-region in the fourth step, discriminated not to belong to the Y-region in the fifth step, discriminated not to belong to the M-region in the sixth step and discriminated not to belong to the R-region in the seventh step, belong to the S-region or not. It is discriminated that the pixels belong to the S-region when Cd'/255+0.1<Md'/255

Md'/255<Cd'/255+0.3

Md'/255+0.1<Yd'/255

Yd'/255<Md'/255+0.2 are satisfied.

Upon executing the above-mentioned first to eighth steps, it is discriminated to which one of eight color regions, i.e., to which one among the GR-region, C-region, B-region, G-region, Y-region, M-region, R-region and S-region each of the pixels belongs. The discrimination expressions in the above-mentioned first to seventh steps were suitably calculated based on Cd, Md and Yd data of each of the colors in a test chart No. 5-1 published by the Japanese Association of Electrophotography. The discrimination expression in the above-mentioned eighth step was experimentally obtained by the present inventor upon closely analyzing a variety of color images. According to experiment conducted by the present inventor, what is interesting is that colors of human faces in a natural color image belong in most cases to the above-mentioned S-region irrespective of white people, yellow people or black people.

With further reference to FIG. 2, a masking processing 22 is executed by a masking means after the color region discrimination processing 20. The masking processing 22 corrects the digital signals Cd', Md' and Yd' on the following masking operation expression (B). Here, however, a combination of the coefficients $a_{ij}$ (i=1, 2, 3, j=1, 2, 3) in the following masking operation expression (B) are different from each other and hence, different masking operation expressions are selected to form corrected digital signals Cd", Md" and Yd", depending upon the above-mentioned eight color regions, i.e., depending upon the GR-region, C-region, B-region, G-region, Y-region, M-region, R-region and S-region and depending upon to which one of divided ranges obtained by dividing the whole tone range into plural ranges each of the digital signals Cd', Md' and Yd' belongs.

$$\begin{vmatrix} Cd'' \\ Md'' \\ Yd'' \end{vmatrix} = \begin{vmatrix} a_{11} & a_{12} & a_{13} \\ a_{21} & a_{22} & a_{23} \\ a_{31} & a_{32} & a_{33} \end{vmatrix} \begin{vmatrix} Cd' \\ Md' \\ Yd' \end{vmatrix} \quad \text{(B)}$$

When the pixels belong to the GR-region, Cd', Md' and Yd' are well-balanced. Therefore, the masking processing GR-22 is executed to effect the correction without breaking the balance (use of a masking operation expression in other color region tends to break the balance). Table 1 shows preferred coefficients $a_{ij}$ in the masking operation expression (B).

TABLE 1

| | Tone range | $a_{i1}$ | $a_{i2}$ | $a_{i3}$ |
|---|---|---|---|---|
| Cd' ($a_{1j}$) | 0–55 | 0.52 | 0.0 | 0.0 |
| | 56–110 | 0.65 | 0.0 | 0.0 |
| | 111–190 | 0.76 | 0.0 | 0.0 |
| | 191–255 | 0.85 | 0.0 | 0.0 |
| Md' ($a_{2j}$) | 0–55 | 0.0 | 0.6 | 0.0 |
| | 56–110 | 0.0 | 0.72 | 0.0 |
| | 111–190 | 0.0 | 0.79 | 0.0 |
| | 191–255 | 0.0 | 0.85 | 0.0 |
| Yd' ($a_{3j}$) | 0–55 | 0.0 | 0.0 | 0.2 |
| | 56–110 | 0.0 | 0.0 | 0.69 |
| | 111–190 | 0.0 | 0.0 | 0.69 |
| | 191–255 | 0.0 | 0.0 | 0.8 |

When, for example, (Cd', Md', Yd') is (115, 108, 114), the masking operation expression is selected as the following expression (C).

$$\begin{vmatrix} Cd'' \\ Md'' \\ Yd'' \end{vmatrix} = \begin{vmatrix} 0.76 & 0.0 & 0.0 \\ 0.0 & 0.72 & 0.0 \\ 0.0 & 0.0 & 0.69 \end{vmatrix} \begin{vmatrix} Cd' \\ Md' \\ Yd' \end{vmatrix} \quad \text{(C)}$$

When the pixels belong to the C-region, the Y-component is too small and the M-component is too large. Therefore, the masking processing C-22 is so executed as to increase Yd' and to decrease Md'. Preferred coefficients $a_{ij}$in the above masking operation expression (B) are as shown in Table 2 below.

TABLE 2

| | Tone range | $a_{i1}$ | $a_{i2}$ | $a_{i3}$ |
|---|---|---|---|---|
| Cd' ($a_{1j}$) | 0–55 | 0.45 | 0.1 | −0.04 |
| | 56–110 | 0.55 | −0.02 | −0.1 |
| | 111–190 | 0.73 | −0.09 | −0.09 |
| | 191–255 | 0.87 | −0.12 | −0.09 |
| Md' ($a_{2j}$) | 0–55 | −0.3 | 0.1 | 0.0 |
| | 56–110 | −0.3 | 0.1 | 0.0 |
| | 111–190 | −0.3 | 0.1 | 0.0 |
| | 191–255 | 0.0 | 0.47 | 0.15 |
| Yd' ($a_{3j}$) | 0–55 | 0.1 | 0.03 | 0.42 |
| | 56–110 | 0.1 | 0.02 | 0.6 |

TABLE 2-continued

| | Tone range | $a_{i1}$ | $a_{i2}$ | $a_{i3}$ |
|---|---|---|---|---|
| | 111–190 | 0.1 | 0.0 | 0.7 |
| | 191–255 | 0.1 | 0.0 | 0.76 |

When the pixels belong to the B-region, the Y-component is too large. Therefore, the masking processing B-22 is so executed as to decrease Yd'. Preferred coefficients $a_{ij}$in the above masking operation expression (B) are as shown in Table 3 below.

TABLE 3

| | Tone range | $a_{i1}$ | $a_{i2}$ | $a_{i3}$ |
|---|---|---|---|---|
| Cd' ($a_{1j}$) | 0–55 | 0.45 | 0.1 | −0.04 |
| | 56–110 | 0.55 | −0.02 | −0.1 |
| | 111–190 | 0.8 | −0.09 | −0.09 |
| | 191–255 | 0.87 | −0.12 | −0.09 |
| Md' ($a_{2j}$) | 0–55 | −0.15 | 0.63 | 0.03 |
| | 56–110 | −0.17 | 0.57 | 0.1 |
| | 111–190 | −0.08 | 0.7 | 0.1 |
| | 191–255 | 0.0 | 0.77 | 0.15 |
| Yd' ($a_{3j}$) | 0–55 | −0.4 | −0.4 | 0.1 |
| | 56–110 | −0.4 | −0.4 | 0.08 |
| | 111–190 | −0.3 | −0.3 | 0.08 |
| | 191–255 | −0.1 | 0.17 | 0.2 |

When the pixels belong to the G-region, the M-component is too small. Therefore, the masking processing G-22 is so executed as to increase Md'. Preferred coefficients $a_{ij}$ in the above masking operation expression (B) are as shown in Table 4 below.

TABLE 4

| | Tone range | $a_{i1}$ | $a_{i2}$ | $a_{i3}$ |
|---|---|---|---|---|
| Cd' ($a_{1j}$) | 0–55 | 0.45 | 0.1 | −0.04 |
| | 56–110 | 0.55 | −0.02 | −0.1 |
| | 111–190 | 0.73 | −0.09 | −0.09 |
| | 191–255 | 0.87 | −0.12 | −0.09 |
| Md' ($a_{2j}$) | 0–55 | −0.15 | 0.63 | 0.03 |
| | 56–110 | −0.17 | 0.57 | 0.1 |
| | 111–190 | −0.08 | 0.7 | 0.1 |
| | 191–255 | 0.0 | 0.77 | 0.15 |
| Yd' ($a_{3j}$) | 0–55 | −0.4 | −0.4 | 0.1 |
| | 56–110 | −0.4 | −0.4 | 0.08 |
| | 111–190 | −0.3 | −0.3 | 0.08 |
| | 191–255 | −0.1 | 0.17 | 0.2 |

When the pixels belong to the Y-region, the M-component is too small. Therefore, the masking processing Y-22 is so executed as to increase Md'. Preferred coefficients $a_{ij}$ in the above masking operation expression (B) are as shown in Table 5 below.

TABLE 5

| | Tone range | $a_{i1}$ | $a_{i2}$ | $a_{i3}$ |
|---|---|---|---|---|
| Cd' ($a_{1j}$) | 0–55 | 0.45 | 0.1 | −0.04 |
| | 56–110 | 0.45 | −0.02 | −0.1 |
| | 111–190 | 0.63 | −0.09 | −0.09 |
| | 191–255 | 0.87 | −0.12 | −0.09 |
| Md' ($a_{2j}$) | 0–55 | 0.0 | 0.8 | 0.1 |
| | 56–110 | 0.0 | 0.77 | 0.1 |
| | 111–190 | 0.0 | 0.77 | 0.1 |
| | 191–255 | 0.0 | 0.77 | 0.15 |
| Yd' ($a_{3j}$) | 0–55 | 0.0 | 0.03 | 0.4 |
| | 56–110 | −0.01 | −0.12 | 0.44 |

TABLE 5-continued

| | Tone range | $a_{i1}$ | $a_{i2}$ | $a_{i3}$ |
|---|---|---|---|---|
| | 111–190 | 0.0 | −0.17 | 0.8 |
| | 191–255 | 0.1 | −0.17 | 0.96 |

When the pixels belong to the M-region, the C-component is excessive to some extent. Therefore, the masking processing M-22 is so executed as to decrease Cd' to some extent. Preferred coefficients $a_{ij}$ in the masking operation expression (B) are as shown in Table 6 below.

TABLE 6

| | Tone range | $a_{i1}$ | $a_{i2}$ | $a_{i3}$ |
|---|---|---|---|---|
| Cd' ($a_{1j}$) | 0–55 | 0.45 | 0.0 | −0.04 |
| | 56–110 | 0.5 | −0.02 | −0.1 |
| | 111–190 | 0.73 | −0.09 | −0.09 |
| | 191–255 | 0.87 | −0.12 | −0.09 |
| Md' ($a_{2j}$) | 0–55 | −0.2 | 0.63 | 0.03 |
| | 56–110 | −0.2 | 0.71 | 0.1 |
| | 111–190 | −0.2 | 0.73 | 0.1 |
| | 191–255 | 0.0 | 0.73 | 0.15 |
| Yd' ($a_{3j}$) | 0–55 | 0.0 | 0.15 | 0.25 |
| | 56–110 | −0.01 | 0.22 | 0.3 |
| | 111–190 | 0.0 | 0.22 | 0.6 |
| | 191–255 | 0.0 | −0.17 | 0.8 |

When the pixels belong to the R-region, the C-component is excessive to some extent. Therefore, the masking processing R-22 is so executed as to decrease Cd' to some extent. Preferred coefficients ail in the masking operation expression (B) are as shown in Table 7 below.

TABLE 7

| | Tone range | $a_{i1}$ | $a_{i2}$ | $a_{i3}$ |
|---|---|---|---|---|
| Cd' ($a_{1j}$) | 0–55 | 0.35 | 0.0 | −0.04 |
| | 56–110 | 0.45 | −0.02 | −0.1 |
| | 111–190 | 0.63 | −0.09 | −0.09 |
| | 191–255 | 0.77 | −0.12 | −0.09 |
| Md' ($a_{2j}$) | 0–55 | 0.15 | 0.6 | 0.03 |
| | 56–110 | −0.01 | 0.57 | 0.13 |
| | 111–190 | −0.08 | 0.62 | 0.15 |
| | 191–255 | 0.0 | 0.77 | 0.15 |
| Yd' ($a_{3j}$) | 0–55 | 0.0 | 0.03 | 0.4 |
| | 56–110 | −0.01 | 0.0 | 0.42 |
| | 111–190 | 0.0 | 0.0 | 0.7 |
| | 191–255 | 0.0 | 0.0 | 0.8 |

When the pixels belong to the S-region, the M-component is excessive (face becomes reddish). Therefore, the masking processing S-22 is so executed as to decrease Md'. Preferred coefficients $a_{ij}$ in the masking operation expression (B) are as shown in Table 8 below.

TABLE 8

| | Tone range | $a_{i1}$ | $a_{i2}$ | $a_{i3}$ |
|---|---|---|---|---|
| Cd' ($a_{1j}$) | 0–100 | 0.13 | 0.1 | −0.04 |
| | 101–150 | 0.20 | −0.02 | −0.10 |
| | 151–190 | 0.25 | −0.09 | −0.09 |
| | 191–255 | 0.30 | −0.12 | −0.09 |
| Md' ($a_{2j}$) | 0–100 | −0.15 | 0.33 | 0.03 |
| | 101–150 | −0.17 | 0.33 | 0.10 |
| | 151–190 | −0.08 | 0.33 | 0.10 |
| | 191–255 | 0.0 | 0.59 | 0.15 |
| Yd' ($a_{3j}$) | 0–100 | 0.0 | 0.03 | 0.90 |
| | 101–150 | −0.01 | −0.12 | 0.90 |

TABLE 8-continued

| Tone range | $a_{i1}$ | $a_{i2}$ | $a_{i3}$ |
|---|---|---|---|
| 151–190 | −0.01 | −0.12 | 0.90 |
| 191–255 | 0.1 | −0.17 | 0.96 |

Figure 3:
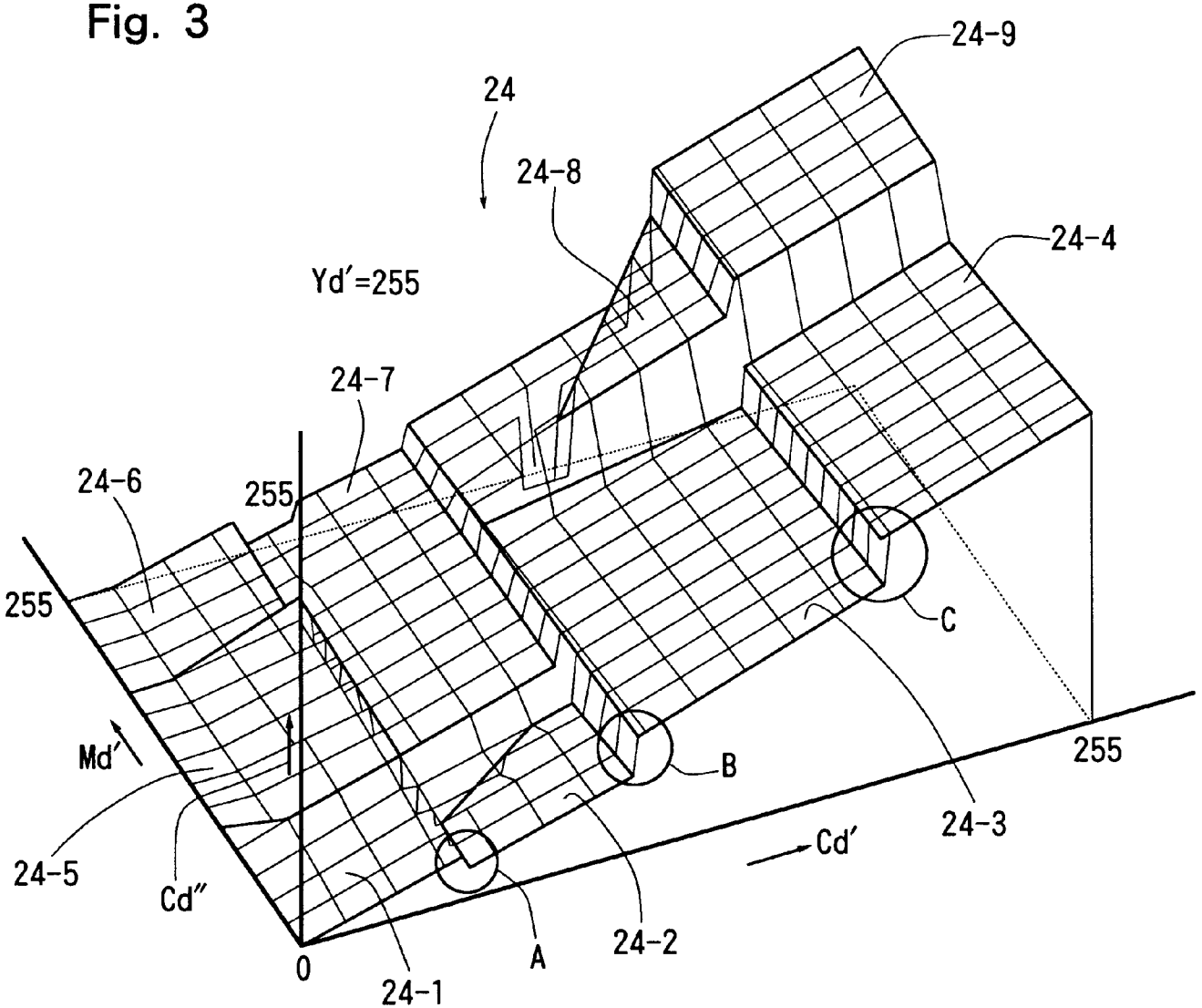
FIG. 3 is a solid diagram illustrating diagrammatically a portion of a masking operation correction table formed in the mode of forming the correction table shown in FIG. 2.

A number of masking operation correction tables are formed by executing the above-mentioned masking processing 22. FIG. 3 diagrammatically shows one example of a masking operation correction table. The masking operation correction table 24 shown in FIG. 2 shows a change in the value of the digital signal Cd" corrected by the values of Cd' and Yd' when the value of Yd' is 255. This masking operation correction table 24 is formed by using nine different masking operation expressions. That is, the following masking operation expressions (1) to (9) are used for the regions 24-1 to 24-9.

$$\begin{vmatrix} Cd'' \\ Md'' \\ Yd'' \end{vmatrix} = \begin{vmatrix} 0.45 & 0.1 & -0.04 \\ 0.3 & 0.1 & 0.0 \\ 0.0 & 0.03 & 0.42 \end{vmatrix} \begin{vmatrix} Cd' \\ Md' \\ Yd' \end{vmatrix} \quad (1)$$

$$\begin{vmatrix} Cd'' \\ Md'' \\ Yd'' \end{vmatrix} = \begin{vmatrix} 0.45 & 0.1 & -0.04 \\ 0.0 & 0.8 & 0.1 \\ 0.0 & 0.03 & 0.4 \end{vmatrix} \begin{vmatrix} Cd' \\ Md' \\ Yd' \end{vmatrix} \quad (2)$$

$$\begin{vmatrix} Cd'' \\ Md'' \\ Yd'' \end{vmatrix} = \begin{vmatrix} 0.73 & -0.09 & -0.09 \\ -0.3 & 0.1 & 0.0 \\ 0.1 & 0.0 & 0.7 \end{vmatrix} \begin{vmatrix} Cd' \\ Md' \\ Yd' \end{vmatrix} \quad (3)$$

$$\begin{vmatrix} Cd'' \\ Md'' \\ Yd'' \end{vmatrix} = \begin{vmatrix} 0.87 & -0.12 & -0.09 \\ 0.0 & 0.47 & 0.15 \\ 0.1 & 0.0 & 0.76 \end{vmatrix} \begin{vmatrix} Cd' \\ Md' \\ Yd' \end{vmatrix} \quad (4)$$

$$\begin{vmatrix} Cd'' \\ Md'' \\ Yd'' \end{vmatrix} = \begin{vmatrix} 0.45 & 0.01 & -0.04 \\ -0.15 & 0.63 & 0.03 \\ 0.03 & 0.0 & 0.3 \end{vmatrix} \begin{vmatrix} Cd' \\ Md' \\ Yd' \end{vmatrix} \quad (5)$$

$$\begin{vmatrix} Cd'' \\ Md'' \\ Yd'' \end{vmatrix} = \begin{vmatrix} 0.55 & -0.02 & -0.1 \\ -0.17 & 0.57 & 0.1 \\ 0.03 & 0.0 & 0.42 \end{vmatrix} \begin{vmatrix} Cd' \\ Md' \\ Yd' \end{vmatrix} \quad (6)$$

$$\begin{vmatrix} Cd'' \\ Md'' \\ Yd'' \end{vmatrix} = \begin{vmatrix} 0.73 & -0.09 & -0.09 \\ -0.08 & 0.62 & 0.1 \\ 0.1 & 0.0 & 0.67 \end{vmatrix} \begin{vmatrix} Cd' \\ Md' \\ Yd' \end{vmatrix} \quad (7)$$

$$\begin{vmatrix} Cd'' \\ Md'' \\ Yd'' \end{vmatrix} = \begin{vmatrix} 0.76 & 0.0 & 0.0 \\ 0.0 & 0.79 & 0.0 \\ 0.0 & 0.0 & 0.69 \end{vmatrix} \begin{vmatrix} Cd' \\ Md' \\ Yd' \end{vmatrix} \quad (8)$$

$$\begin{vmatrix} Cd'' \\ Md'' \\ Yd'' \end{vmatrix} = \begin{vmatrix} 0.85 & 0.0 & 0.0 \\ 0.0 & 0.85 & 0.0 \\ 0.0 & 0.0 & 0.8 \end{vmatrix} \begin{vmatrix} Cd' \\ Md' \\ Yd' \end{vmatrix} \quad (9)$$

In the above-mentioned examples, the coefficient $a_{ij}$ of the masking operation expression (B) is changed depending upon to which one of the divided ranges obtained by dividing the whole tone range (0 to 255 tone levels) into four ranges (0 to 55, 56 to 110, 111 to 190, and 191 to 255 ranges in the GR-region, C-region, B-region, G-region, Y-region, M-region and R-region, and 0 to 100, 101 to 150, 151 to 190, and 191 to 255 ranges in the S-region) each of the Cd', Md' and Yd' belongs. As required, however, the whole tone range may be divided into two, three, five or more ranges, and the coefficient a,, of the masking operation formula (B) may be changed depending upon to which range each of them belongs. Or, the coefficient $a_{ij}$ of the masking operation formula (B) may be used in common for all of the tone range.

Figure 4:
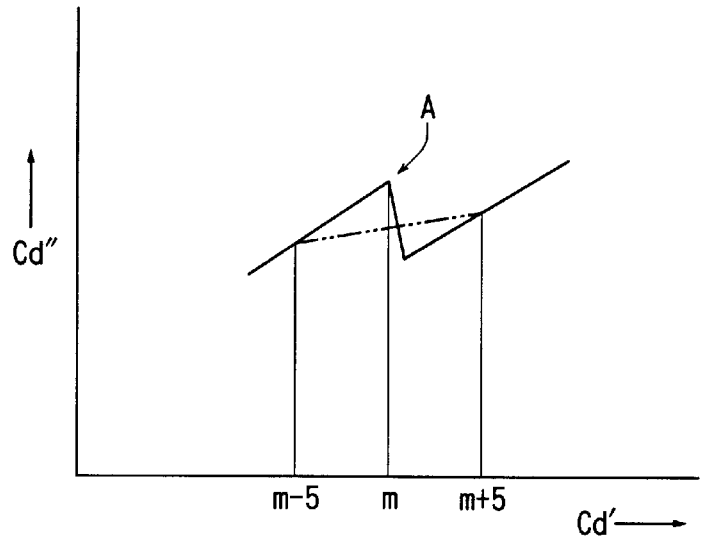
FIG. 4 is a diagram illustrating a singular portion in the masking operation correction table shown in FIG. 3 and a mode of correcting such a singular portion.
Figure 5:
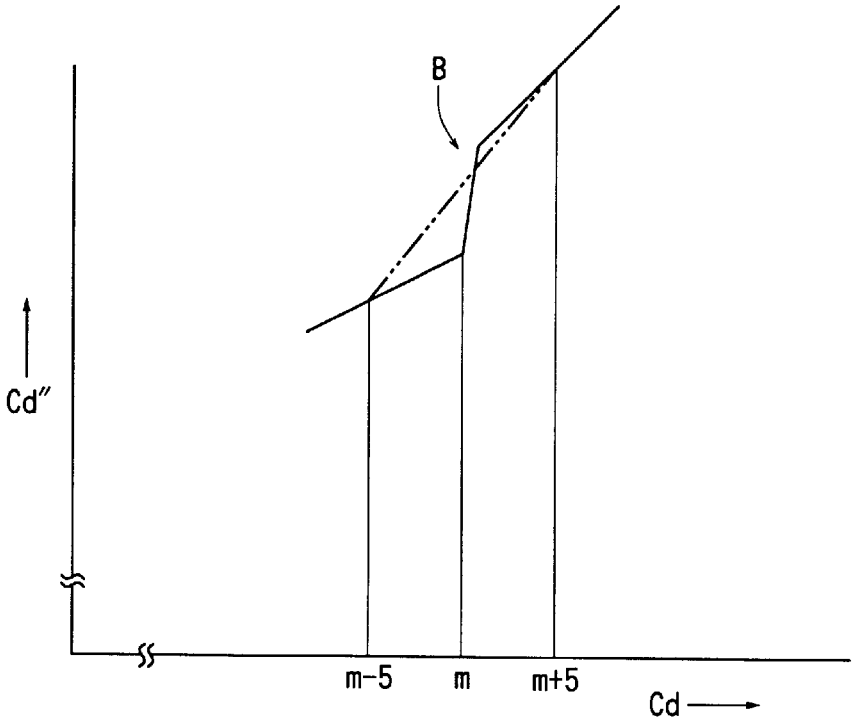
FIG. 5 is a diagram illustrating another singular portion in the masking operation correction table shown in FIG. 3 and a mode of correcting such a singular portion.

With further reference to FIGS. 2 and 3, according to the present invention, the singular portion detection processing 26 is executed after the masking operation correction tables are formed as described above. Referring to the masking operation correction table 24 shown in FIG. 3, it is checked how Cd" changes in accordance with a change in the Cd' when Md' is, first, 0 (in the masking operation correction table 24 shown in FIG. 3, Yd' is 255 and remains constant). In a preferred example of checking, the value of Cd" is checked when Cd' is increased by predetermined tone levels which may be, for example, five tone levels, and such a checking is effected for each of the Cd' values of from 0 to 255. When the value Cd" decreases at a moment when Cd' has increased from n to n+a (a is an integer which may be, for example 5), it is recognized that a singular portion exists. In the masking operation correction table 24 shown in FIG. 3, when Md' is 0, it is recognized that there exists a singular portion where Cd" decreases at a portion indicated by A. When the presence of such a singular portion A is recognized, the change of Cd" is checked for each tone level while Cd' increases from n to n+a, and it is recognized that Cd' decreases when Cd' increases from m to m+1, as shown in FIG. 4. When the singular portion A is detected as described above, the singular portion correction processing 28 is subsequently executed. The singular portion A is corrected in a manner that the value of Cd" increases linearly and gradually when Cd' increases from m−5 to m+5 as indicated by a two-dotted chain line in FIG. 4. Even a case where the value of Cd" increases in excess of predetermined tone levels which may be, for example, 10 tone levels when Cd' increases from n to n+a, the presence of a singular portion is recognized therebetween. In the masking operation correction table 24 shown in FIG. 3, when Md' is 0, it is recognized that Cd" increases in excess of predetermined tone levels at a portion denoted by B (and at a portion denoted by C). When the presence of such singular portions B (and C) is recognized, a change of Cd" is checked for each tone level while Cd' increases from n to n+a, and it is recognized that Cd" sharply increases when Cd' increases from m to m+1 as shown in FIG. 5. Even when the singular portions B (and C) are detected as described above, the singular portion correction processing 28 is subsequently executed. The singular portions B (and C) are corrected in a manner that the value of Cd" increases linearly and gradually when Cd' increases from m−5 to m+5 as shown by a two-dot chain line in FIG. 5.

The above-mentioned check and correction are effected for each of the Md' values of from 0 to 255. Then, it is checked how Cd" changes in accordance with a change of Md' for each of the Cd' values of from 0 to 255. The same check and correction are effected for each of the Yd' values of from 0 to 255. Moreover, it is checked how Cd" changes in accordance with a change of Yd' for each of the Cd' values of from 0 to 255 and for each of the Md' values of from 0 to 255. Thus, the singular portion detection processing 26 and the singular portion correction processing 28 are finished for the Cd" values. Thereafter, the singular portion detection processing 26 and the singular portion correction processing 28 are similarly effected for the Md" values and for the Yd" values. Thus, the masking operation correction table 24 is suitably corrected as required, and the correction table 16 is formed.

With reference to FIG. 1, the color image-forming means 10 forms a color image based on the digital signal BKd fed after the black-forming processing 12, based on the digital signal BKd' fed after the background removal processing 14, and based on the digital signals Cd", Md" and Yd" fed after the correction processing 18. As required, in this case, signal processings are executed for changing the magnification, for adjusting the density, etc. that are known among people skilled in the art. Thus, there can be obtained a color copy having a color image excellent in color reproduceability in all color regions for the color document.

In the foregoing was described in detail a preferred embodiment of the color image-forming machine constituted according to the present invention with reference to the accompanying drawings. It should, however, be noted that the invention is in no way limited to the above-mentioned embodiment only but can be changed or modified in a variety of ways without departing from the scope of the invention.

What I claim is:

1. A color image-forming machine comprising:

a color image signal-forming means for outputting digital signals Cd, Md and Yd expressing, on tone levels, three primary colors C, M and Y for each of a number of pixels, and a correction means for correcting the digital signals Cd, Md and Yd; wherein said correction means includes a correction table and corrects said digital signals Cd, Md and Yd according to said correction table and singular portions;

said correction table is formed by forming masking operation correction tables which define corrected digital signals Cd', Md' and Yd' obtained by correcting the digital signals Cd, Md and Yd based on a plurality of different masking operation expressions corresponding to a predetermined plural number of regions, and then, detecting singular portions on the corrected digital signals Cd', Md' and Yd' defined by said masking operation correction tables, and modifying the corrected digital signals Cd', Md' and Yd' at said singular portions;

said plurality of masking operation expressions include masking operation expressions selected for a plurality of predetermined color regions; and said plurality of predetermined color regions are determined based on a relative ratio of said digital signals Cd, Md and Yd.

2. A color image-forming machine according to claim 1, wherein said singular portions are detected by detecting said corrected digital signals Cd', Md' and Yd' that have decreased or increased in excess of a predetermined range when said digital signals Cd, Md and Yd have increased by predetermined tone levels in each of the three primary colors C, M and Y.

3. A color image-forming machine according to claim 1, wherein said plurality of color regions include a GR-region, a C-region, a B-region, a G-region, a Y-region, an M-region, an R-region and an-S region.

4. A color image-forming machine according to claim 1, wherein said plurality of masking operation expressions include masking operation expressions selected for the tone level regions that are obtained by dividing the whole tone level ranges of the digital signals Cd, Md and Yd into a plurality of ranges in each of said plurality of color regions.

5. A method of forming a correction table in a color image-forming machine having a color image signal-forming means for outputting digital signals Cd, Md and Yd expressing, on tone levels, three primary colors C, M and Y for each of a number of pixels, and a correction means for correcting the digital signals Cd, Md and Yd based on said correction table; said method comprising:

forming masking operation correction tables to define the corrected digital signals Cd', Md' and Yd' obtained by correcting the digital signals Cd, Md and Yd based on a plurality of different masking operation expressions corresponding to a predetermined plural number of regions, detecting singular portions on the corrected digital signals Cd', Md' and Yd' defined by said masking operation correction tables, and modifying the corrected digital signals Cd', Md' and Yd' at said singular portions; and wherein said plurality of masking operation expressions include masking operation expressions selected for a plurality of predetermined color regions, and said plurality of predetermined color regions are determined based on a relative ratio of said digital signals Cd, Md and Yd.

6. A method according to claim 5, wherein said singular portions are detected by detecting said corrected digital signals Cd', Md' and Yd' that have decreased or increased in excess of a predetermined range when said digital signals Cd, Md and Yd have increased by predetermined tone levels in each of the three primary colors C, M and Y.

7. A method according to claim 5, wherein said plurality of color regions include a GR-region, a C-region, a B-region, a G-region, a Y-region, an M-region, an R-region and an-S region.

8. A method according to claim 5, wherein said plurality of masking operation expressions include masking operation expressions selected for the tone level regions that are obtained by dividing the whole tone level ranges of the digital signals Cd, Md and Yd into a plurality of ranges in each of said plurality of color regions.

* * * * *